US006260499B1

(12) United States Patent
Steel et al.

(10) Patent No.: US 6,260,499 B1
(45) Date of Patent: Jul. 17, 2001

(54) ENCLOSURE FOR PARTIALLY SUBMERGED BOAT KEELS, RUDDERS AND OUTDRIVES

(76) Inventors: Richard Ernest Steel, 1116 E. 38th Pl., Tulsa, OK (US) 74105; John S Zink, P.O. Box 525058, Skiatook, OK (US) 74152

( * ) Notice: Subject to any disclaimer, the term of this patent is extended or adjusted under 35 U.S.C. 154(b) by 0 days.

(21) Appl. No.: 09/629,331

(22) Filed: Aug. 1, 2000

Related U.S. Application Data

(63) Continuation-in-part of application No. 09/375,770, filed on Aug. 17, 1999, now abandoned.

(51) Int. Cl.[7] ..... B36B 59/00
(52) U.S. Cl. ..... 114/222
(58) Field of Search ..... 114/162, 45, 222; 440/113

(56) References Cited

U.S. PATENT DOCUMENTS 5,152,242 * 10/1992 Bradley ..... 114/222
5,315,949 * 5/1994 Bradley ..... 114/222
5,465,676 * 11/1995 Falcaro ..... 114/222
5,549,069 * 8/1996 Faidi ..... 114/222

* cited by examiner

*Primary Examiner*—Stephen Avila

(57) ABSTRACT

The device of the present invention, an enclosure for partially submerged boat keels, rudders and lower units, is a box-like structure constructed to enclose those described parts extending downwards from the hull of a boat when the boat is lifted from the water on a hoist in such a manner as to prevent direct contact with the water. The device is positioned about the submerged portion of the keel, rudder or lower unit and then emptied of water, resulting in flotation of the upper portions of the enclosure to a level above the surrounding waterline. By thus preventing continuous direct contact with water during periods of storage, the adverse effects of bottom growth and gelcoat blistering are reduced or eliminated, thus enhancing performance underway and reducing maintenance.

3 Claims, 8 Drawing Sheets

1

ENCLOSURE FOR PARTIALLY SUBMERGED BOAT KEELS, RUDDERS AND OUTDRIVES

This application is a Continuation In Part of our previous patent application No. 09/375,770 filed Aug. 17, 1999, now abandoned.

CROSS-REFERENCE TO RELATED APPLICATIONS

NOT APPLICABLE

STATEMENT REGARDING FEDERALLY SPONSERED RESEARCH OR DEVELOPMENT

NOT APPLICABLE

REFERENCE TO A MICROFICHE APPENDIX

NOT APPLICABLE

BACKGROUND OF THE INVENTION

Boats in the range of 18–30 feet of length are commonly stored on boat hoists. Such hoists are designed to lift the boat from the water in order to prevent problems such as bottom growth and blistering. Many sailboats have keels or rudders whose height is greater than the lifting capacity of the hoist in use. Likewise, many powerboats have outdrives or outboard engines (collectively referred to hereinafter as lower units) whose height exceeds the lifting capacity of the hoist in use. When such boats are lifted on their respective hoists, the lower sections of the keel, rudder or lower unit remain submerged.

A common solution to the problem of bottom growth on these partially submerged appendages is enclosing the appendage in a plastic bag and introducing some chlorine bleach into the interior. While somewhat effective in halting bottom growth, this attempt both introduces pollutants to the waterways and fails to isolate the appendages from the water, thereby allowing blistering of the gelcoat.

There have been introduced other solutions to the problem of bottom growth, such as the Barnacle Sheild by Falcaro U.S. Pat. No. 5,465,676 which supplies an envelope of flexible material supported about the hull by means of a floating frame and into which fresh water is supplied. While this invention is not intended for use on a boat partially submerged in water, it's lessons are applicable. The problems with this type of treatment are the same as that of the more simplistic plastic bag and bleach approach—a failure to isolate the immersed boat appendages from the water.

This invention relates to the field of devices designed to protect the submerged portions of keels, rudders and lower units of boats partially lifted from the water from bottom growth, blistering and related problems which commonly occur to those submerged portions when in continual direct contact with water.

The device of the present invention, an enclosure for partially submerged boat keels, rudders and lower units, is a box-like structure constructed to enclose those described parts extending downwards from the hull of a boat when the boat is lifted from the water on a hoist in such a manner as to prevent direct contact with the water. The device is positioned about the submerged portion of the keel, rudder or lower unit and then emptied of water, resulting in flotation of the upper portions of the enclosure to a level above the surrounding waterline. By thus preventing continuous direct contact with water during periods of storage, the adverse effects of bottom growth and gelcoat blistering are reduced or eliminated, thus enhancing performance underway and reducing maintenance.

BRIEF DESCRIPTION OF THE DRAWINGS

Further details are explained below with the help of examples illustrated in the attached drawings in which.

DETAILED DESCRIPTION OF THE INVENTION

Figure 1:
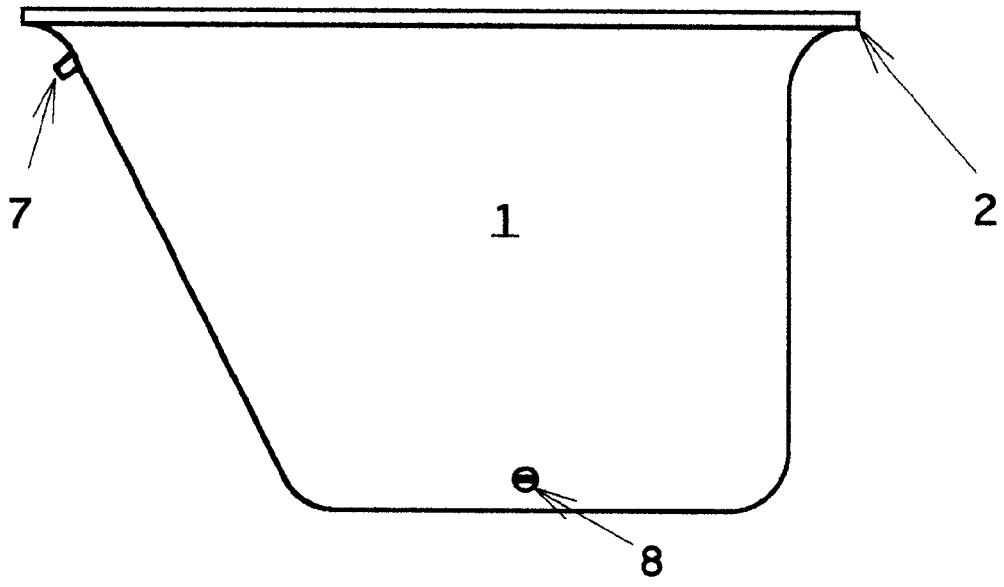
FIG. 1 is a side elevation view of a preferred embodiment of an enclosure of the present invention.
Figure 2:
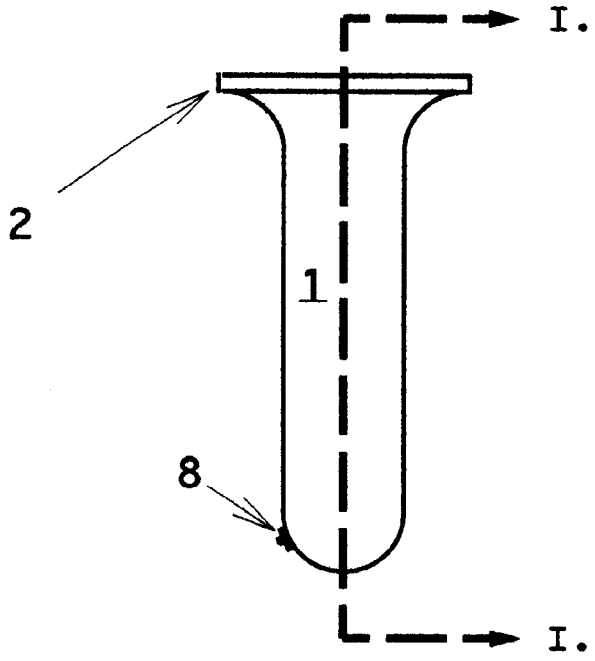
FIG. 2 is an end elevation view of a preferred embodiment of an enclosure of the present invention.

In FIGS. 1 and 2, a structure 1 is disclosed having sides and a bottom but is open at the top. The shape of said structure may be similar to that of a keel, rudder or lower unit about which the structure will be installed; the structure is designed to provide a clearance fit about the keel, rudder or lower unit. The structure is constructed of a positively bouyant material; foam-filled fiberglass reinforced plastic, wood and polypropelyne are all examples of suitable materials. The top periphery of the structure 2 may be formed as an outward flange to inhibit entry of water carried by wave action into the interior of the structure.

Figure 3:
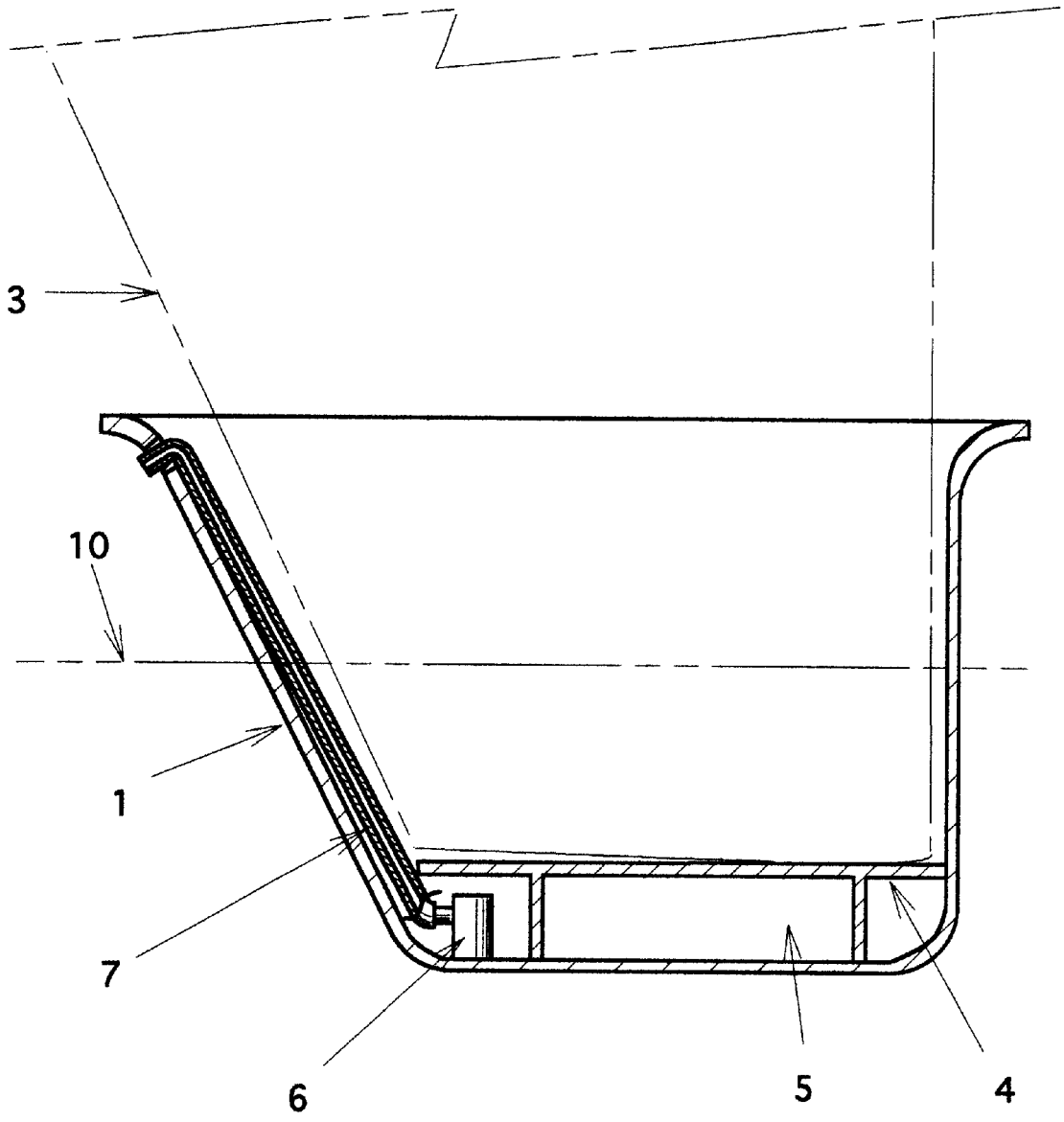
FIG. 3 is a cross section I—I of a preferred embodiment of an enclosure of the present invention in which the enclosure is installed about a partially submerged keel and from which water from the interior of the structure has been expelled.

FIG. 3 is a sectional view taken along Section l—l showing an enclosure positioned about a partially submerged fin keel 3. A grate 4 is fixed on a horizontal plane in the interior of the structure some distance above the bottom; the grate limits the upwards movement of the structure during installation and thereby provides a sump area 5 in the bottom of the structure. In FIG. 3 the enclosure is empty of water and floating as high as allowed by the contact of the lowermost point of fin keel 3 against the top surface of the grate 4; it is seen that the upper section of the enclosure is above the water line 10. A means of expelling water from the interior of the enclosure such a a submersible water pump 6 is fixed to the interior bottom of the structure. A discharge device 7 is attached at one end to the pump and at another end passes through the structure near the top of the structure. A means of actuating the pump 6 (not shown) is provided. This means may be manual or alternatively may be an automatic float switch. A means of supplying water 8 to the interior of the enclosure is provided at the level of the sump area 5; this may be a valve or a plug or a like device. Alternatively, manually applied downwards pressure to the top of the enclosure to submerge one of the upper edges is adequate to supply water to the interior of the enclosure. The sump area 5 provides a basin for water not completely expelled by the pump 6. A means of supplying water to the iinterior of the enclosure allows water to flood the enclosure when opened, thus allowing the enclosure to be more easily removed from about the fin keel 3 in preparation for lowering the boat into the water.

Figure 5:
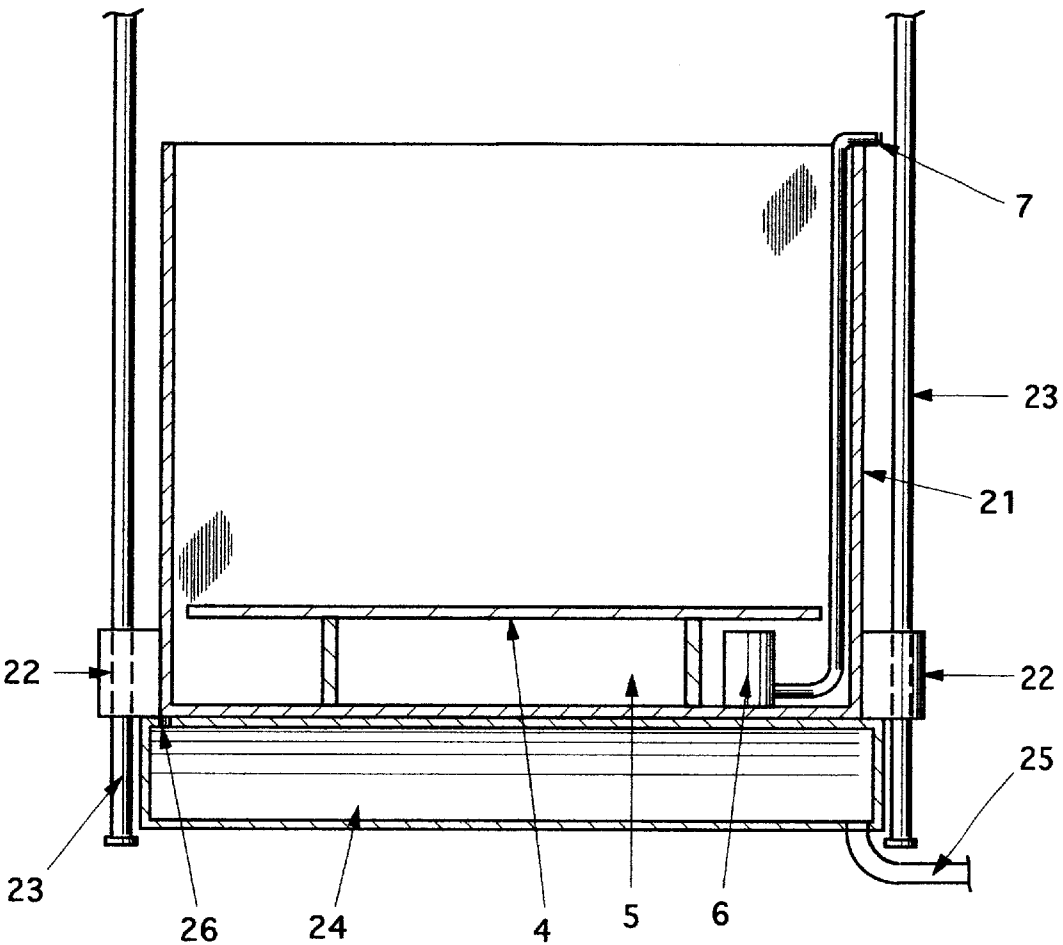
FIG. 5 is a front sectional view of a second embodiment of an enclosure of the present invention.
Figure 4:
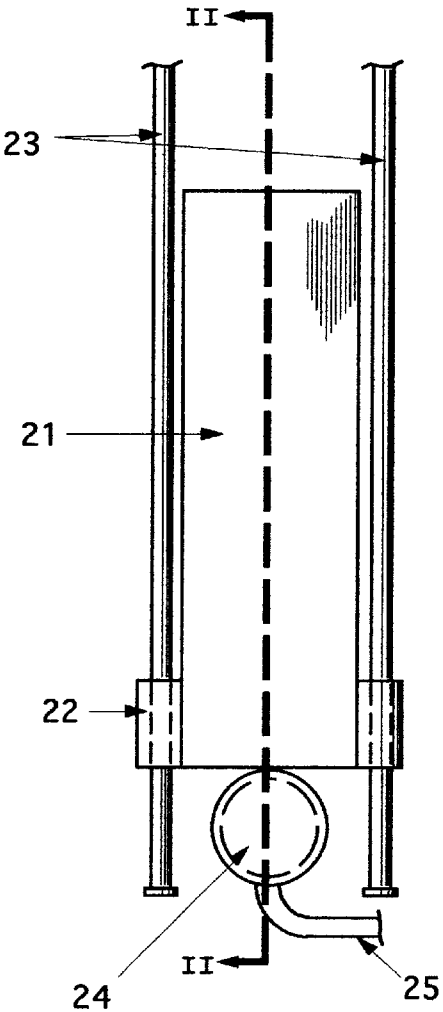
FIG. 4 is a side elevation view of a second embodiment of an enclosure of the present invention.

FIGS. 4 and 5 disclose another embodiment of the present invention in which FIG. 5 is a Section II—II of FIG. 4. The enclosure 21 is constructed of a negatively bouyant material and is slidingly attached to the boat hoist by bushings 22 about rods 23 which are fixed to the boat hoist. A flotation chamber 24 is fixed to the exterior bottom of the enclosure 21, having an air supply means 25 at one end and air exhaust means 26 at another end. The air exhaust means may be a plurality of through holes. The other parts of the enclosure are the same as that of the previously described embodiment; there is a grate 4, a sump area 5, a pump 6, a means of exhausting water 7 and a means of actuating the pump 6, but there is not required a means of supplying water.

Figure 6:
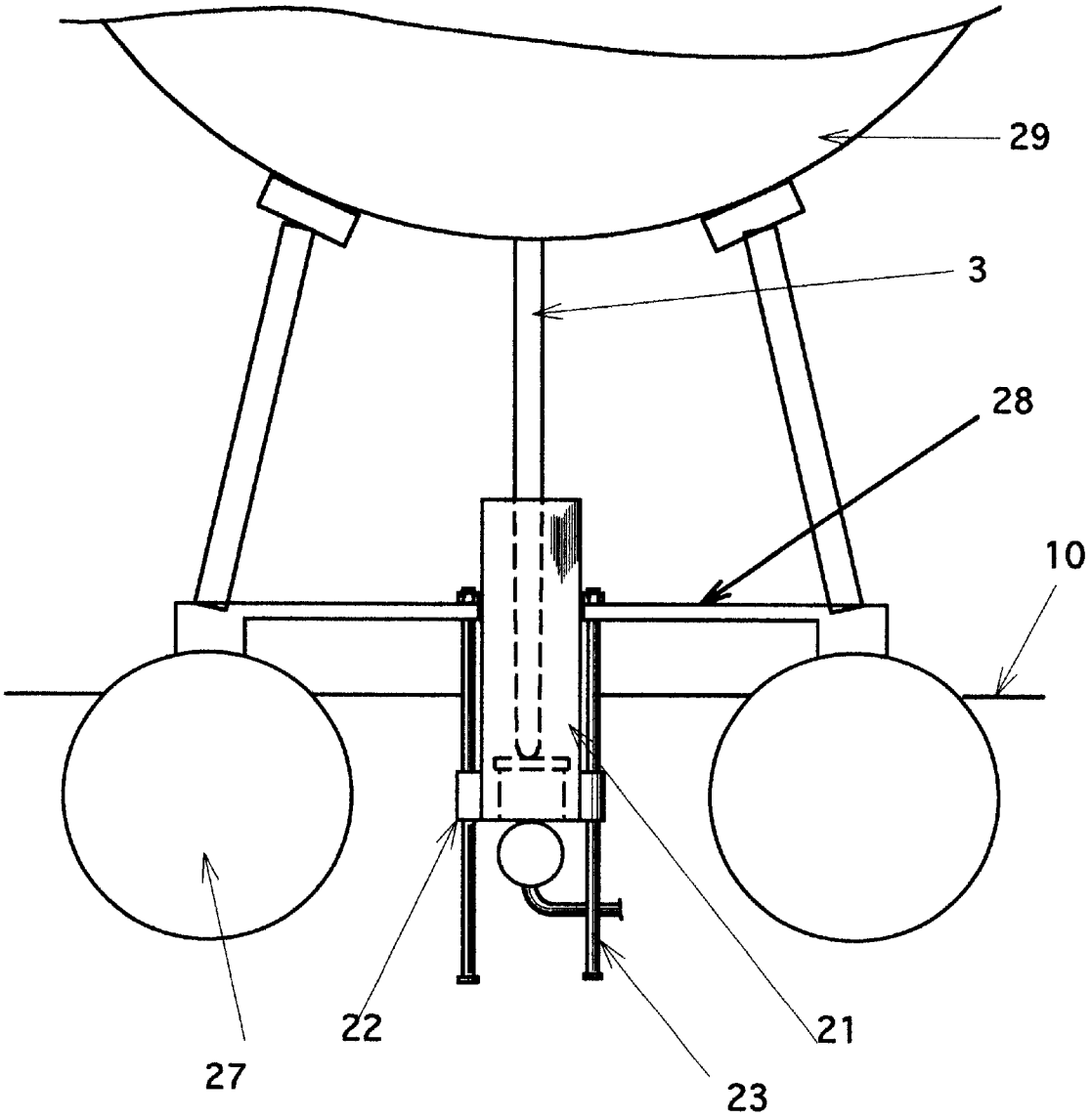
FIG. 6 is a side elevation view of a second embodiment of an enclosure as installed on a typical boat hoist.

FIG. 6 discloses a sailboat stored on a boat hoist 27 which is floating about the waterline 10. The instant embodiment is attached to boat hoist 27 by means of support assembly 28, from which rods 23 extend downwards and to which enclosure 21 is slidingly engaged via bushings 22. It will be seen that the structure is in alignment with the fin keel 3 of a sailboat to be positioned on the hoist.

Figure 7:
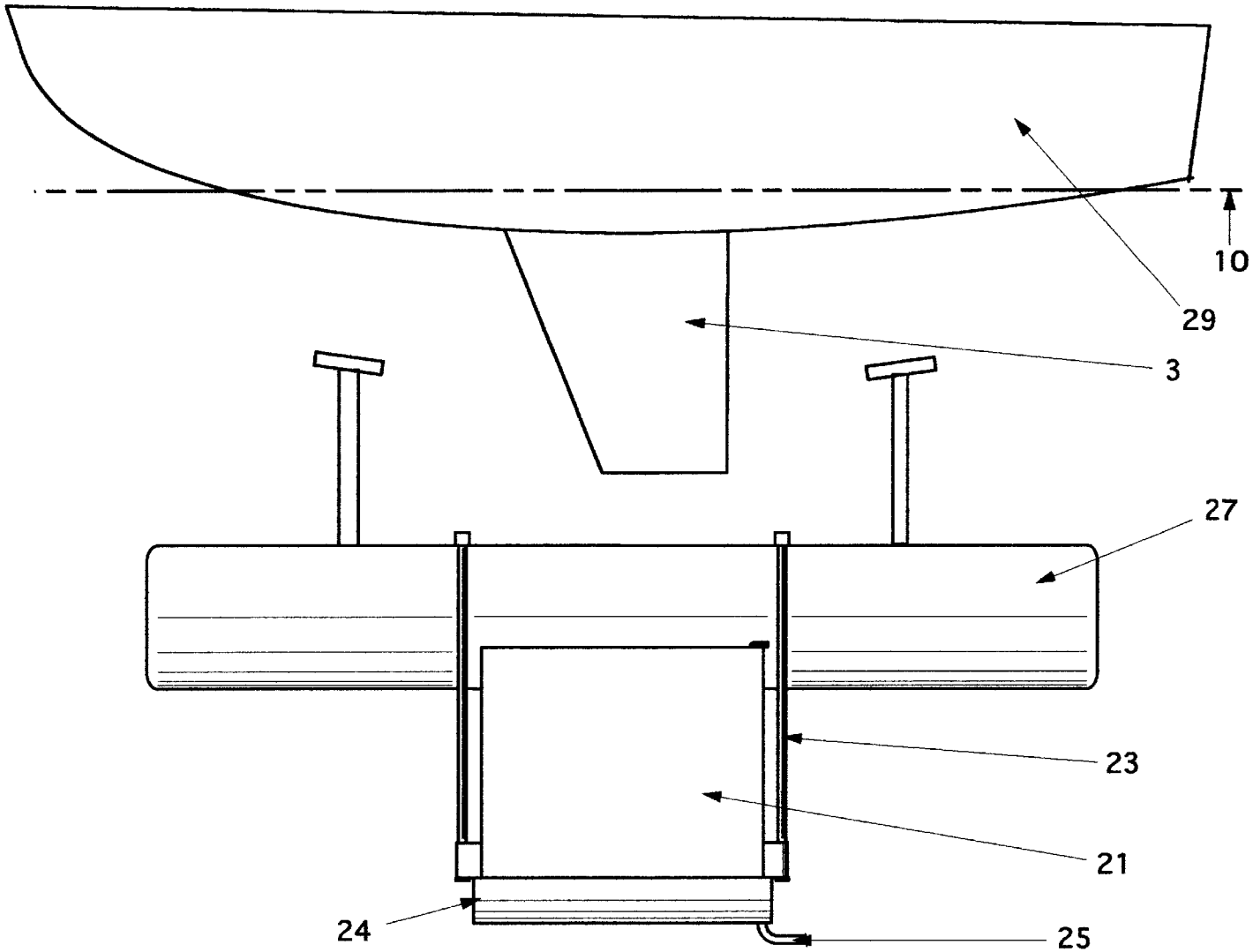
FIGS. 7–10 are side elevation views of a second embodiment of an enclosure as installed on a typical boat hoist depicting operation of the second embodiment.

FIG. 7, 8, 9 and 10 successively depict the operation of the instant embodiment. In FIG. 7, the hoist 27 is below the waterline 10 and the enclosure 21 is resting at the bottom of rods 23. The flotation chamber 24 is full of water. Boat 29 is positioned above the hoist in preparation for lifting and fin keel 3 is above the enclosure 21.

Figure 8:
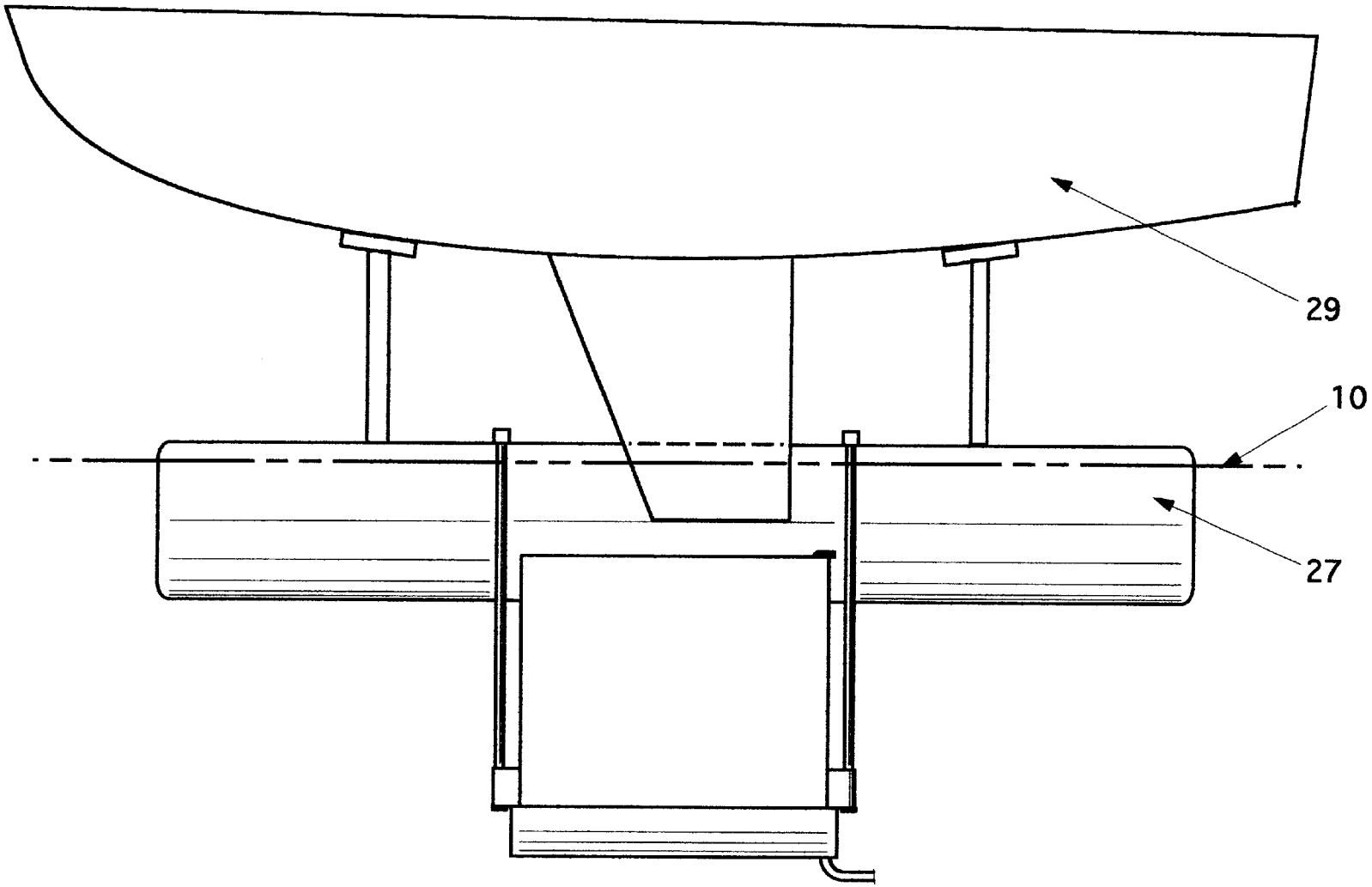

In FIG. 8 the hoist 27 is raised thereby lifting the boat 29 until the hoist 27 is floating about the waterline 10.

Figure 9:
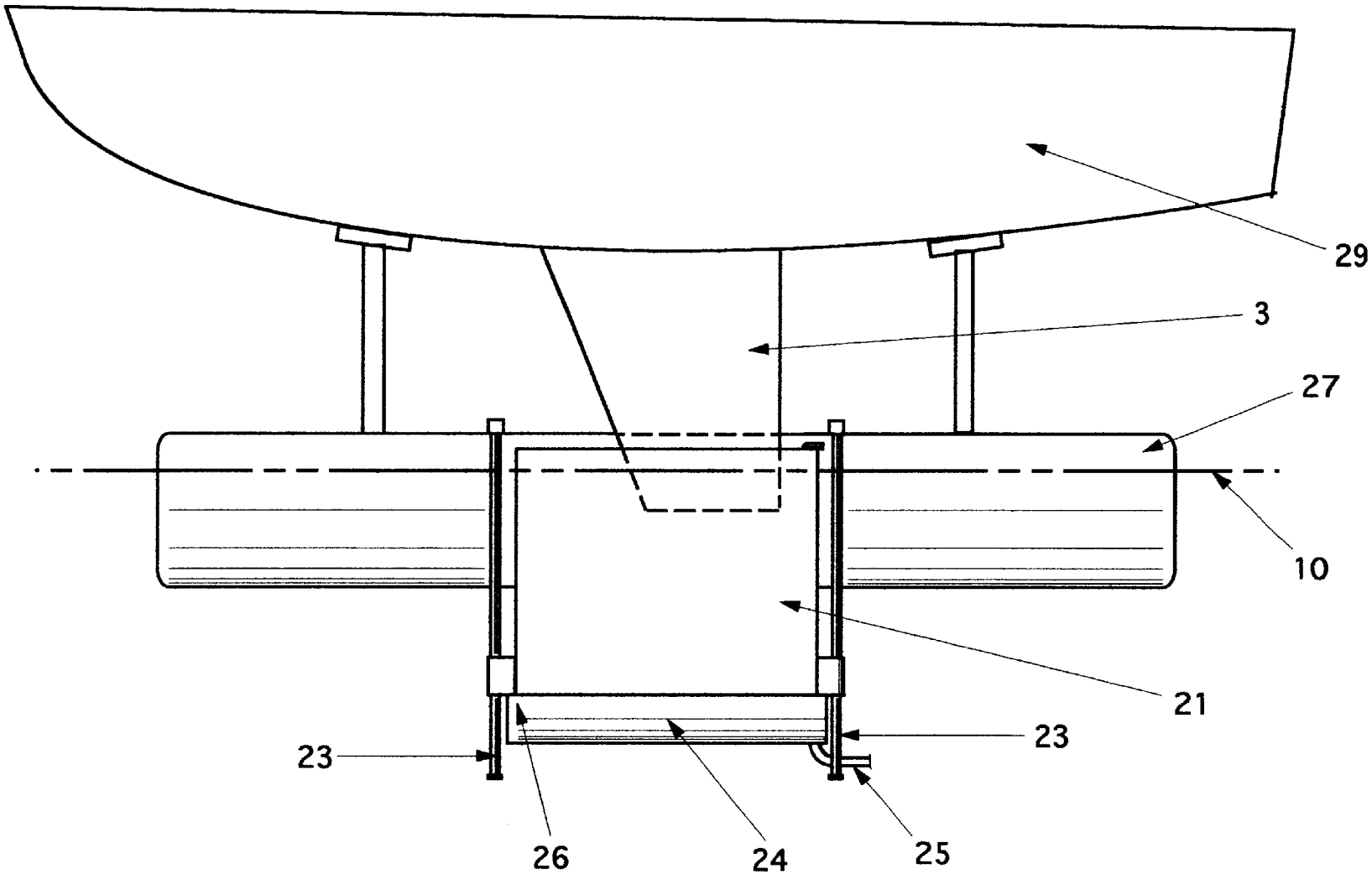

In FIG. 9, air is supplied to the flotation chamber 24 via air supply means 25. Air is supplied at a rate greater than the exhaust rate of air exhaust means 26 thus raising the enclosure along rods 23 until the top of the enclosure is above the waterline 10.

Figure 10:
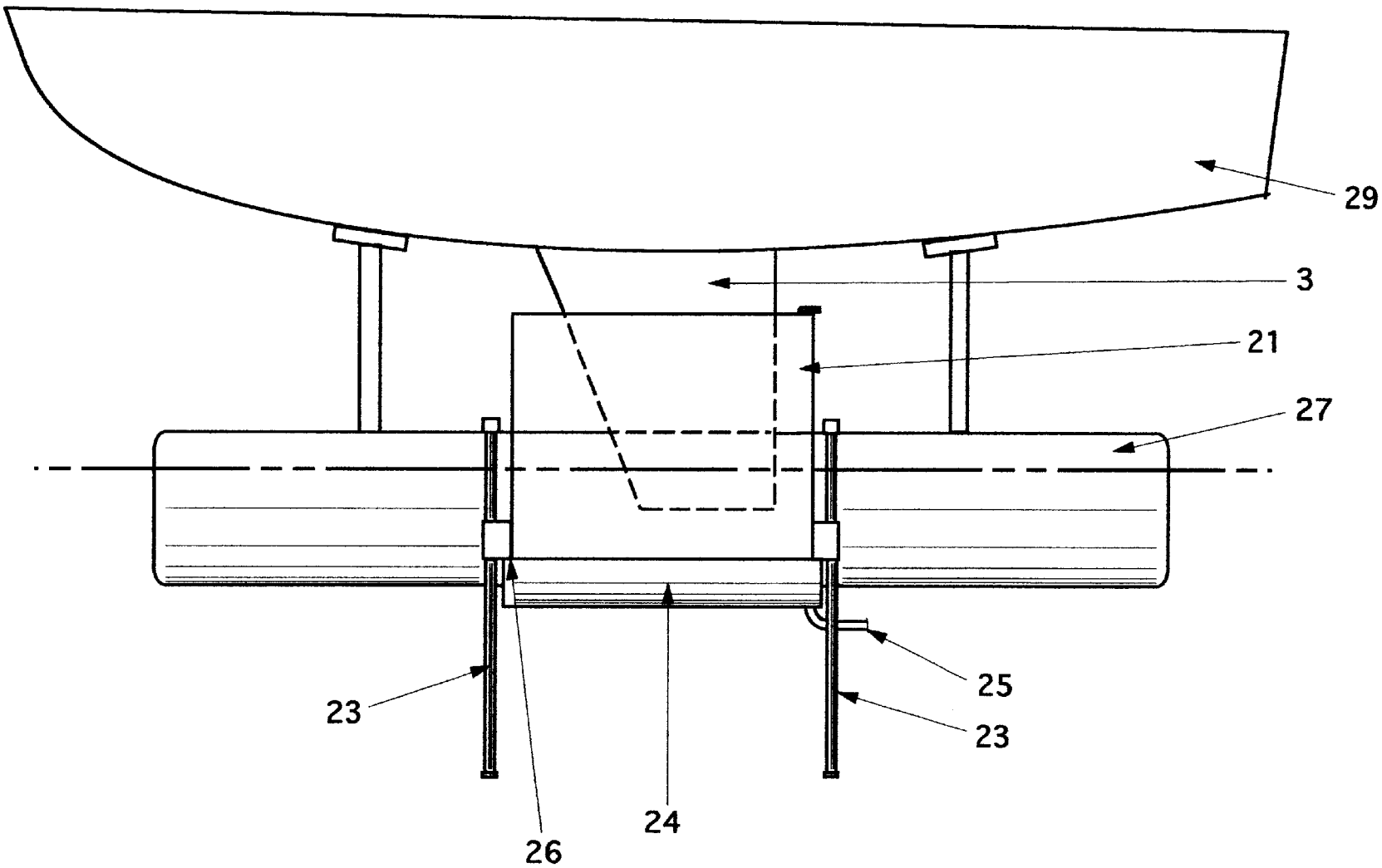

In FIG. 10, the pump (not shown) is next actuated emptying the enclosure 21 of water. The enclosure 21 moves upwards until the fin keel 3 contacts the grate (not shown). Once at the upper limit of travel, the pump is switched off. As the pump empties the enclosure 21 of water, the means of supplying air 25 is disengaged and the air in flotation chamber 24 is exhausted via air exhaust means 26. The enclosure will sink to the bottom of the rods once the hoist is lowered and water spills over the top into the interior of the enclosure, thereby lowering the enclosure from around the fin keel 3 in preparation for the boat exiting the slip.

While the invention has been described in reference to a fin keel of a sailboat, same invention can be applied to a rudder or lower unit of a powerboat, wherein the essential components and construction of the enclosure are the same with differences only in the placement of the enclosure on the hoist and the methods of attachment. It should be noted that while one embodiment is described herein as slidingly engaged to the boat hoist, application of the same enclosure to a lower unit may instead be a hinge-type mechanism or other mechanism designed to facilitate attachment of the enclosure to an end of the boat hoist. Also, the invention has been described in reference to a "pontoon-type" floating boat hoist but it will be apparent to those skilled in the art that it may be readily applied to other types of boat hoists.

What we claim is:

1. A device on a boat lifted above the water except for a keel to prevent bottom growth and blistering while the boat is stored comprising, a removable structure closely enclosing the keel, the removable structure extending from just below the keel at the bottom to the top of the keel at the top, a grate to support the bottom of the keel, a means of expelling water from the structure including a submersible pump directly attached to the interior bottom of the removable structure, a discharge device extending from the pump to the top of the enclosure, a sump at the bottom of the enclosure.

2. A device on a boat lifted above the water except for a rudder to prevent bottom growth and blistering while the boat is stored comprising, a removable structure closely enclosing the rudder, the removable structure extending from just below the rudder at the bottom to the top of the rudder at the top, a grate to support the bottom of the rudder, a means of expelling water from the structure including a submersible pump directly attached to the interior bottom of the removable structure, a discharge device extending from the pump to the top of the enclosure, a sump at the bottom of the enclosure.

3. A device on a boat lifted above the water except for a lower unit to prevent bottom growth and blistering while the boat is stored comprising, a removable structure closely enclosing the lower unit, the removable structure extending from just below the lower unit at the bottom to the top of the lower unit at the top, a grate to support the bottom of the lower unit, a means of expelling water from the structure including a submersible pump directly attached to the interior bottom of the removable structure, a discharge device extending from the pump to the top of the enclosure, a sump at the bottom of the enclosure.

* * * * *